United States Patent [19]

Takano et al.

[11] Patent Number: 4,726,199

[45] Date of Patent: Feb. 23, 1988

[54] SUPERCONDUCTING APPARATUS

[75] Inventors: Ichiro Takano, Zama; Hirotsugu Ohguma, Kawasaki; Hideki Nakagome; Yoshio Gomei, both of Yokohama, all of Japan

[73] Assignee: Kabushiki Kaisha Toshiba, Kawasaki, Japan

[21] Appl. No.: 767,964

[22] Filed: Aug. 21, 1985

[30] Foreign Application Priority Data

Sep. 17, 1984 [JP] Japan ..... 59-194420

[51] Int. Cl.[4] ..... F25B 31/00

[52] U.S. Cl. ..... 62/505; 62/119; 165/47; 165/104.21; 174/15 CA; 335/216

[58] Field of Search ..... 62/119, 505, 514 R; 174/15 CA; 335/216; 165/47, 104.21

[56] References Cited

U.S. PATENT DOCUMENTS

| | | | |
|---|---|---|---|
| 3,035,419 | 5/1962 | Wigert | 62/119 |
| 3,766,502 | 10/1973 | Bronca et al. | 174/15 CA |
| 3,847,208 | 11/1974 | Ollendorf | 165/47 |
| 4,377,938 | 3/1983 | Crespin | 62/505 |

FOREIGN PATENT DOCUMENTS

| | | |
|---|---|---|
| 0011267 | 5/1980 | European Pat. Off. . |
| 0144873 | 6/1985 | European Pat. Off. . |
| 59-34267 | 8/1984 | Japan . |
| 489926 | 6/1970 | Switzerland . |

*Primary Examiner*—Ronald C. Capossela

*Attorney, Agent, or Firm*—Oblon, Fisher, Spivak, McClelland & Maier

[57] ABSTRACT

Disclosed is a superconducting apparatus comprising a superconducting coil and a cooling apparatus for cooling this superconducting coil. The cooling apparatus is constituted by a cooling medium circulating path for subjecting a cooling medium to a vaporization/liquefication cycle, and a temperature equalizing plate for effecting a uniform cooling of the superconducting coil by the cooling medium. The cooling medium circulating path is constituted by a pair of flowing-down parts through which a liquid cooling medium flows downwards by gravity, and a pair of vaporization parts through which the liquid cooling medium flows upwards while it is being vaporized. The temperature-equalizing plate covers the peripheral surface making one entire round of the superconducting coil around the axis of the coil. It is divided into at least two parts at its lower end, which are electrically insulated from each other.

23 Claims, 2 Drawing Figures

SUPERCONDUCTING APPARATUS

BACKGROUND OF THE INVENTION

I. Field of the Invention:

The present invention relates to a superconducting apparatus capable of being miniaturized and, more particularly, to a cooling apparatus for a superconducting coil of the superconducting apparatus.

II. Description of the Prior Art:

In a superconducting apparatus, it is necessary to cool a superconducting coil thereof down to a temperature which is as low as, for example, 4° k. Hitherto, the cooling of a superconducting coil has been performed through immersing this coil itself in a liquid helium reservoir. This method, however, has drawbacks in that a large space for the liquid helium reservoir is necessary, a large quantity of liquid helium must be stored, the process steps of making the liquid helium reservoir are complicated, etc.

Another method of cooling the superconducting coil by forcedly circulating a coolant such as, for example, liquid helium through a coolant circulating path connected to the superconducting coil has also been proposed, said coolant circulating path being connected to said superconducting coil in such a manner that heat transfer can be effected therebetween. In this second method, however, since it is necessary to provide a means of subjecting the coolant to forced circulation, it is difficult to apply this method to a small-sized superconducting coil and obtain a small-sized superconducting apparatus.

OBJECT OF THE INVENTION

The object of the present invention is to provide a superconducting apparatus capable of being miniaturized, in which a superconducting coil can be cooled with uniformity.

SUMMARY OF THE INVENTION

A superconducting apparatus in accordance with the present invention comprises a superconducting coil and a cooling apparatus for cooling this superconducting coil. The cooling apparatus is constituted by a cooling medium circulating path for subjecting a cooling medium to a vaporization/liquefication cycle, and a temperature equalizing plate for effecting a uniform cooling of the superconducting coil by the cooling medium. The cooling medium circulating path is constituted by a pair of flowing-down parts through which the liquid cooling medium flows downwards by gravity, and a pair of vaporization parts through which the liquid cooling medium flows upwards while it is being vaporized. The temperature-equalizing plate covers the peripheral surface making one entire round of the superconducting coil around the axis of the coil. It is divided into two parts at least at its lower end, which are electrically insulated from each other.

In the above-mentioned superconducting apparatus, the cooling medium circulating path may be constituted by cooling pipes. In this case, the flowing-down part may be constituted by a single pipe which is straight or bent along its temperature-equalizing plate. Further, the vaporization part may be constituted by a pipe which is curved or bent in a zigzag manner. Alternatively, the vaporization part may be constituted by a plurality of pipes or zigzag pipes whose upper and lower ends are connected to common headers, respectively.

The temperature-equalizing plate can be constituted by a plurality of (e.g., a pair of) arched plates which are arranged to have a cylindrical shape as a whole. These arched plates are electrically insulated from each other to thereby prevent an eddy current from being produced in the temperature-equalizing plate. As a result, the induction heating of the same is prevented.

In the superconducting apparatus of the invention, the cooling medium is circulated due to the density difference produced by its vaporization, so that the cooling of the superconducting coil is effected with an extremely high uniformity.

DETAILED DESCRIPTION OF THE PREFERRED EMBODIMENTS

Preferred embodiments of the invention will now be described with reference to the drawings.

Figure 1:
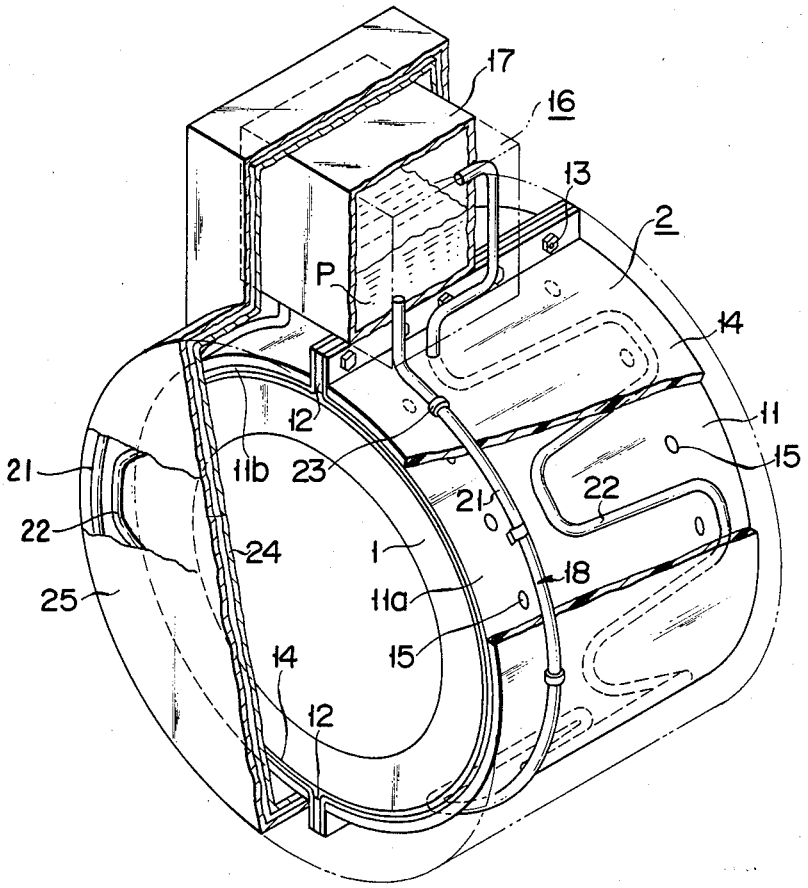
FIG. 1 is a perspective view of a superconducting coil according to a first embodiment of the invention.

FIG. 1 shows a superconducting apparatus according to a first embodiment of the invention. In FIG. 1, a superconducting coil 1 which is made in the form of an annular ring is cooled to a very low temperature by a cooling apparatus 2 covering the entire outer peripheral surface of the superconducting coil 1.

The cooling apparatus 2 is constituted by a cooling assembly 16 and a temperature-equalizing plate 11 which covers the entire outer peripheral surface of the cylindrical superconducting coil 1. The temperature-equalizing plate 11 is constituted by a pair of arched plates 11*a* and 11*b* each formed of a material having high heat conductivity--such as, for example, copper. The ends of each arched plate 11*a* or 11*b* are bent in the radially outward direction of the coil 1, respectively, to thereby form a rib. Of these ribs, two opposed ribs are joined together by insulating bolts 13 with an insulating plate 12 interposed therebetween, thereby constituting the temperature-equalizing plate 11. By insulating each of the arched plates 11*a* and 11*b* from the other as mentioned above, it is possible to prevent the induction heating of the temperature-equalizing plate 11 due to the excitation of the superconducting coil 1. In order to increase the efficiency of heat transfer between the temperature-equalizing plate 11 and the superconducting coil 1, both are made integral by means of an epoxy resin 14 having substantially the same heat expansion coefficient as that of copper and having a high heat conductivity. In this case, the temperature-equalizing plate 11 is formed with a plurality of bores 15 via which the temperature-equalizing plate 11 is made integral with the epoxy resin 14. Accordingly, the temperature-equalizing plate 11 and the epoxy resin 14 are thermally shrunk in a state wherein both are integrated together.

The superconducting coil 1 is cooled via the temperature-equalizing plate 11 by the cooling assembly 16, which is a gravity-drop circulating system. The cooling assembly 16 is constituted by a liquid helium tank 17 installed above the coil 1, and a cooling pipe unit 18 for circulating a cooling medium from a bottom portion of the liquid helium tank 17 to a side portion thereof by way of a specified arrangement of passages. The liquid helium tank 17 is intended to store therein liquid helium P. The cooling pipe unit 18 has two systems of pipes, on the outer surfaces of the paired arched plates 11*a* and 11*b* constituting the temperature-equalizing plate 11. In FIG. 1, however, only the pipe system on the outer surface of the arched plate 11*a* is shown in detail. (The pipe system on the outer surface of the arched plate 11*b* is the mirror image of the pipe system on the outer surface of the arched plate 11*a*, as suggested by the breakaway.) Each system of pipes is constituted by a flowing-down part 21 which extends downwards along the outer surface of the temperature-equalizing plate 11 from the bottom portion of the liquid helium tank 17, and a vaporization part 22 which extends upwards from a lower end of the flowing-down part 21 while it zigzags up along the outer surface of the temperature-equalizing plate 11, to reach a position above a free liquid surface of the liquid helium tank 17. The flowing-down part 21 is fixed to the temperature-equalizing plate 11 via heat insulating spacers 23 having low heat conductivity and thus is heat-insulated therefrom by means of the heat insulating spacers 23. The vaporization part 22 is fixed, by, for example, soldering, to the temperature-equalizing plate 11 at its specified portions or over its entire length in a state of having been cohered thereto. Further, the vaporization part 22 is embedded in the epoxy resin 14.

The superconducting coil 1 and the cooling apparatus 2 are enveloped by a radiation shield 24 having a temperature of, for example, approximately 50° to 80° k and, further, are received as a whole in a vacuum container 25, to thereby prevent the entry thereinto of heat from outside.

In the superconducting apparatus having the foregoing construction, the superconducting coil 1 is cooled as follows. The liquid helium P stored in the liquid helium tank 17 flows downwards by gravity from the bottom portion of the liquid helium tank 17 through the flowing-down part 21 of the cooling pipe unit 18. Since the flowing-down part 21 is thermally insulated from the temperature-equalizing plate 11, the liquid helium P reaches the lowermost end of that flowing-down part 21 while its temperature is kept as it is. Subsequently, the liquid helium P reaches the lowermost portion of the vaporization part 22. Since the vaporization part 22 is connected to the temperature-equalizing plate 11 in such a manner that heat transfer between the two is effected, heat exchange between the liquid helium P and the superconducting coil 1 is effected at the vaporization part 22 via the temperature-equalizing plate 11, the liquid helium P thus being vaporized. The helium thus vaporized rises through the vaporization part 22, which is curved in a zigzag manner, to return to the position above the free liquid surface of the liquid helium tank 17. The liquid helium tank 17 thus returned is liquefied by a liquefying apparatus not shown and is again circulated through the cooling pipe unit 18 from the liquid helium tank 17, in the above-mentioned manner.

In the refrigeration cycle which has been explained above, a difference of density is created between the cooling medium in the flowing-down part 21 of the cooling pipe unit 18 and the cooling medium in the vaporization part 22 thereof, and this density difference produces a power for circulating the cooling medium. The above-mentioned cooling apparatus, therefore, does not require the use of a means for circulating the cooling medium.

As stated above, in the superconducting apparatus shown in FIG. 1, it is possible to circulate the cooling medium without using any means for forced circulation of the same. For this reason, it is possible to miniaturize and simplify the superconducting apparatus as a whole.

Figure 2:
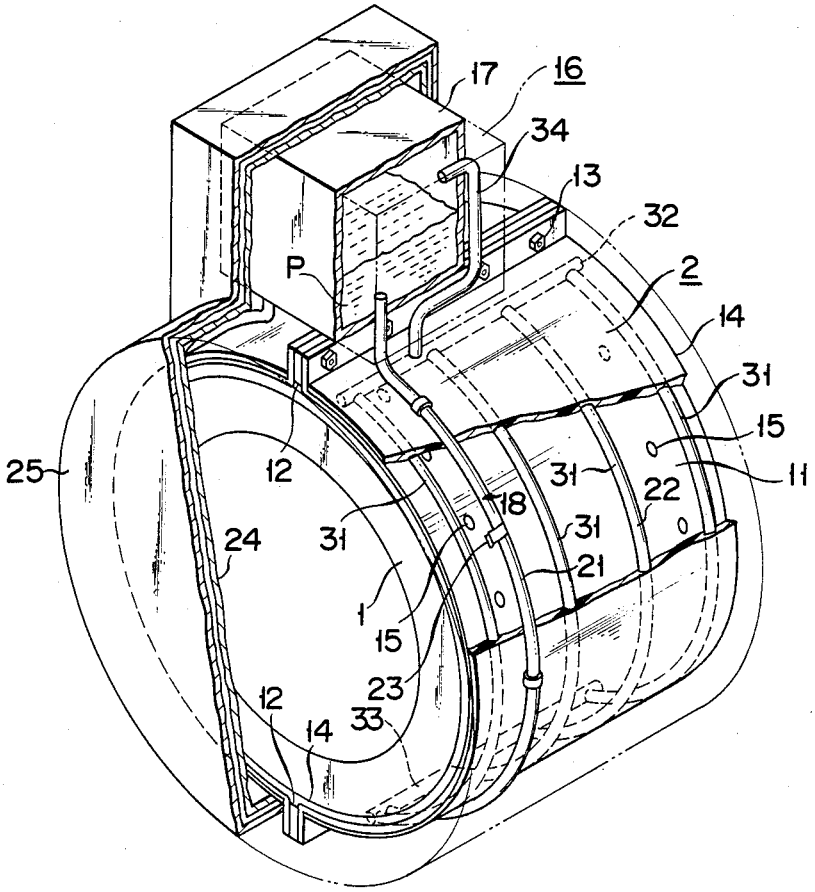
FIG. 2 is a perspective view of a superconducting apparatus according to another embodiment of the invention.

FIG. 2 shows a superconducting apparatus according to a second embodiment of the invention. This superconducting apparatus differs from that which is shown in FIG. 1 in respect of the construction of the vaporization part 22 of the cooling pipe unit 18. That is, in the superconducting apparatus of FIG. 2, each vaporization part 22 is constituted by a plurality of circumferentially extending branched pipes 31 which are cohered on the outer surface of the temperature-equalizing plate 11, and headers 32 and 33 each of which connects the corresponding ends, at one side, of the associated branched pipes 31. Accordingly, the liquid helium P flows downwards from the liquid helium tank 17 into the flowing-down part 21 of the cooling pipe unit 18 to reach the header 33 connected to the lower end thereof and, thereafter, flows upwards from the header 33 through the associated branched pipes 31. In this process of upward flow, heat exchange is effected between the liquid helium P and the superconducting coil 1, so that the liquid helium P is vaporized. The vaporized helium flows are joined together in the header 32 connected to the upper ends of the branched pipes 31. The resultant helium gas passes through a return pipe 34 into the liquid helium tank 17.

In the construction shown in FIG. 2, the manufacture of the vaporization part 22 of the cooling pipe 18 is easier than in the construction shown in FIG. 1, and it is possible to increase the rate of circulation of the cooling medium, so that the cooling efficiency can be greater, than in the construction shown in FIG. 1.

The present invention is not limited to the above-mentioned embodiments. For example, in the superconducting apparatus of FIG. 2, the branched pipes 31 may be curved in a zigzag manner. By so doing, it is possible to further enhance the cooling efficiency. Even in this case, no particular difficulty is caused in manufacturing the branched pipes 31.

What is claimed is:

1. A superconducting apparatus comprising a superconducting coil and a cooling apparatus for cooling said superconducting coil, said cooling apparatus being constituted by a cooling medium circulating path for subjecting a cooling medium to a vaporization/liquefication cycle, and a temperature equalizing plate for effecting a uniform cooling of said superconducting coil by said cooling medium, said cooling medium circulating path being constituted by a pair of flowing-down parts through which a liquid cooling medium flows downwards by gravity, and a pair of vaporization parts through which said liquid cooling medium flows upwards while it is being vaporized, said temperature-equalizing plate covering the peripheral surface making one entire round of said superconducting coil around the axis of said superconducting coil and being divided into at least two parts, said at least two parts being electrically insulated from each other.

2. A superconducting apparatus as set forth in claim 1, wherein said cooling medium circulating path comprises a cooling pipe unit through which said cooling medium flows.

3. A superconducting apparatus as set forth in claim 1, wherein:

(a) each one of said pair of flowing-down parts is heat-insulated from said temperature-equalizing plate and (b) each one of said pair of vaporization parts is thermally connected to said temperature-equalizing plate so as to enable heat transfer between them.

4. A superconducting apparatus as set forth in claim 3, wherein each one of said pair of flowing-down parts comprises a single pipe which is straight or bent along said temperature-equalizing plate.

5. A superconducting apparatus as set forth in claim 4, wherein each one of said pair of vaporization parts comprises a pipe curved in a zig-zag manner.

6. A superconducting apparatus as set forth in claim 4, wherein each one of said pair of vaporization parts comprises a pipe array comprising a plurality of pipes having their mutually corresponding ends commonly connected with headers.

7. A superconducting apparatus as set forth in claim 5, wherein each one of said pair of vaporization parts comprises a pipe array comprising a plurality of zig-zag curved pipes having their mutually corresponding ends commonly connected with corresponding headers.

8. A superconducting apparatus as set forth in claim 1, wherein said temperature-equalizing plate comprises a plurality of divided arched plate members which are electrically insulated from each other.

9. A superconducting apparatus as set forth in claim 1, wherein said superconducting coil and said temperature-equalizing plate are made integral with each other by organic resin.

10. A superconducting apparatus as set forth in claim 9, wherein said temperature-equalizing plate is formed with a plurality of bores.

11. A superconducting apparatus comprising:

(a) an annular superconducting coil having a longitudinal axis which, during use of said super conducting apparatus, is at least approximately horizontal;

(b) an annular temperature equalizing plate surrounding said annular superconducting coil;

(c) a tank which, during use of said superconducting apparatus, contains a liquid cooling medium disposed above said annular temperature equalizing plate;

(d) a first path of fluid communication having an inlet in fluid communication with said tank and an outlet beneath said annular temperature equalizing plate, said first path of fluid communication being thermally insulated from said annular temperature equalizing plate; and (e) a second path of fluid communication having an inlet in fluid communication with the outlet of said first path of fluid communication and at least one outlet in fluid communication with said tank, said second path of fluid communication being in thermal contact with said annular temperature equalizing plate on both circumferential sides of said annular temperature equalizing plate, whereby, during use of said superconducting apparatus, a liquid cooling medium stored in said tank flows downwardly through said first path of fluid communication under the force of gravity, after which it flows upwardly through said second path of fluid communication while being vaporized, thereby effecting a uniform cooling of said annular superconducting coil.

12. A superconducting apparatus as recited in claim 11 wherein said annular temperature equalizing plate comprises two semi-cylindrical parts which are electrically insulated from each other.

13. A superconducting apparatus as recited in claim 11 wherein said first path of fluid communication comprises two pipes, one of which goes around each circumferential side of said annular temperature equalizing plate.

14. A superconducting apparatus as recited in claim 11 wherein said second path of fluid communication comprises two pipes, one of which goes around each circumferential side of said annular temperature equalizing plate.

15. A superconducting apparatus as recited in claim 14 wherein said two pipes zig-zag in the axial direction.

16. A superconducting apparatus as recited in claim 11 wherein said second path of fluid communication comprises a plurality of axially spaced pipes.

17. A superconducting apparatus as recited in claim 16 wherein at least some of said plurality of axially spaced pipes zig-zag in the axial direction.

18. A superconducting apparatus as recited in claim 16 wherein at least some of said plurality of axially spaced pipes are connected at their tops and bottoms by headers.

19. A superconducting apparatus as recited in claim 11 and further comprising a layer of organic resin disposed between said annular superconducting coil and said annular temperature equalizing plate.

20. A superconducting apparatus as recited in claim 19 wherein said layer of organic resin has substantially the same heat expansion coefficient as said annular temperature equalizing plate and has a high heat conductivity.

21. A superconducting apparatus as recited in claim 19 wherein a plurality of bores are formed in said temperature equalizing plate for the introduction of said organic resin in liquid form.

22. A superconducting apparatus as recited in claim 11 and further comprising a radiation shield surrounding said annular temperature equalizing plate.

23. A superconducting apparatus as recited in claim 22 and further comprising a vacuum container surrounding said radiation shield.

* * * * *